US006575139B2

(12) United States Patent
Rodriguez-Amaya et al.

(10) Patent No.: US 6,575,139 B2
(45) Date of Patent: Jun. 10, 2003

(54) INJECTION DEVICE COMPRISING AN ACTUATOR FOR CONTROLLING THE NEEDLE STROKE

(75) Inventors: Nestor Rodriguez-Amaya, Stuttgart (DE); Roger Potschin, Brackenheim (DE); Ulrich Projahn, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 26 days.

(21) Appl. No.: 09/979,034

(22) PCT Filed: Feb. 22, 2001

(86) PCT No.: PCT/DE01/00677

§ 371 (c)(1),
(2), (4) Date: Mar. 18, 2002

(87) PCT Pub. No.: WO01/69076

PCT Pub. Date: Sep. 20, 2001

(65) Prior Publication Data

US 2002/0113139 A1 Aug. 22, 2002

(30) Foreign Application Priority Data

Mar. 15, 2000 (DE) ..... 100 12 552

(51) Int. Cl.[7] ..... F02M 37/04
(52) U.S. Cl. ..... 123/467; 123/506
(58) Field of Search ..... 123/467, 500, 123/501, 458, 506

(56) References Cited

U.S. PATENT DOCUMENTS

| | | | | | |
|---|---|---|---|---|---|
| 3,742,918 | A | * | 7/1973 | Murtin et al. | 123/458 |
| 4,211,202 | A | * | 7/1980 | Hafner | 123/457 |
| 4,249,497 | A | * | 2/1981 | Eheim et al. | 123/446 |
| 5,823,161 | A | * | 10/1998 | Potz et al. | 123/305 |
| 5,890,471 | A | * | 4/1999 | Nishimura | 123/496 |
| 5,893,350 | A | * | 4/1999 | Timms | 123/467 |
| 5,913,300 | A | * | 6/1999 | Drummond | 123/467 |
| 6,189,509 | B1 | * | 2/2001 | Froment | 123/467 |
| 6,286,484 | B1 | * | 9/2001 | Niethammer et al. | 123/447 |

FOREIGN PATENT DOCUMENTS

EP 0823549 * 2/1998

* cited by examiner

*Primary Examiner*—Carl S. Miller
(74) *Attorney, Agent, or Firm*—Ronald E. Greigg

(57) ABSTRACT

The invention relates to an arrangement for injecting fuel, which is at high pressure, into an internal combustion engine. An injector (25) encloses a pressure chamber (1), from which a high-pressure line (3) discharges into a control chamber (4) of a nozzle needle (5). Also contained in the injector (25) are two control valves (11, 12), which on the outlet side communicate with regions (9) of a lesser pressure level. One of the control valves (11, 12) that form the injection course (20) contains a pressure compensation system (34), by which the injection pressure course (20) can be varied by varying the stroke length (23) of the nozzle needle (5).

9 Claims, 5 Drawing Sheets

INJECTION DEVICE COMPRISING AN ACTUATOR FOR CONTROLLING THE NEEDLE STROKE

CROSS-REFERENCE TO RELATED APPLICATIONS

This application is a 35 USC 371 application of PCT/DE 01/00677 filed on Feb. 22, 2001.

BACKGROUND OF THE INVENTION

1. Field of the Invention

The invention relates to an injection arrangement having an actuator for needle stroke control, in order to achieve a variable opening pressure of the nozzle needle. Such injection arrangements are preferentially used in fuel injection systems of internal combustion engines in motor vehicles 2. Prior Art From European Patent Disclosure EP 0 823 549 A2, an injector for an injection system in internal combustion engines is known. In the injector housing of this industrial embodiment, two control valves located one after the other are provided, triggered by a magnet. The triggering of one of the two valves necessarily causes the actuation of the further valve. The advantage of this embodiment is the pressure compensation of the needle control valve in all operating states; the disadvantage of this embodiment is that decoupling of the reciprocation events of the two in-line valves is not possible with embodiment of EP 0 823 549 A2. This in turn limits the possibilities for varying the injection pressure course considerably. With the embodiment of EP 0 823 549 A2, it is difficult to achieve an adaptation of the injection pressure course to individual requirements for certain designs of internal combustion engines.

SUMMARY OF THE INVENTION

By the triggering of the control valves in the injector by a piezoelectric actuator, while avoiding magnet valves that take up installation space, very fast valve switching times can be attained by means of piezoelectric actuators. This has an especially favorable effect at relatively high rpm, at which the available time for combustion becomes less and less anyway, and the accurate formation of the injection pressure course definitively affects the course of combustion. Another advantage is the substantially more-compact structural shape that can be attained by using a piezoelectric actuator and that becomes possible by means of an offset disposition of the control valve and actuator. Thus greater freedom of design is available for the geometric design of an injector of this kind.

The decoupling of the two control valves provided in the injector housing from one another also makes it possible to produce the components at less expense. No added production variations are created, so that the production tolerances can have a tendency to be widened, which favorably affects the production costs for the components. Also because of the widening of the production tolerances, the range of deviation of individual examples of a given injector in one production batch can be reduced. The leakage losses during the injection event are completely suppressed; a leakage loss occurs only during the pressure buildup phase—when the nozzle needle is supposed to remain closed.

The injection arrangement of the present invention allows a variation of the opening pressure of the nozzle needle for the preinjection phase, main injection phase, and optionally a postinjection phase that may be required. A postinjection at an elevated pressure level is possible by means of the pressure compensation system at one of the control valves. Depending on how a throttle element, which is assigned to a nozzle needle spring chamber that acts on the nozzle needle, is designed, the absolute highest pressure established toward the end of the main injection upon further triggering of one of the two control valves can be specified in a targeted way, as can the course of the pressure increase up to the highest value.

BRIEF DESCRIPTION OF THE DRAWINGS

The invention will be described in further detail below in conjunction with the drawings, in which.

Shown are.

DESCRIPTION OF THE PREFERRED EMBODIMENTS

Variant Embodiments

Figure 1:
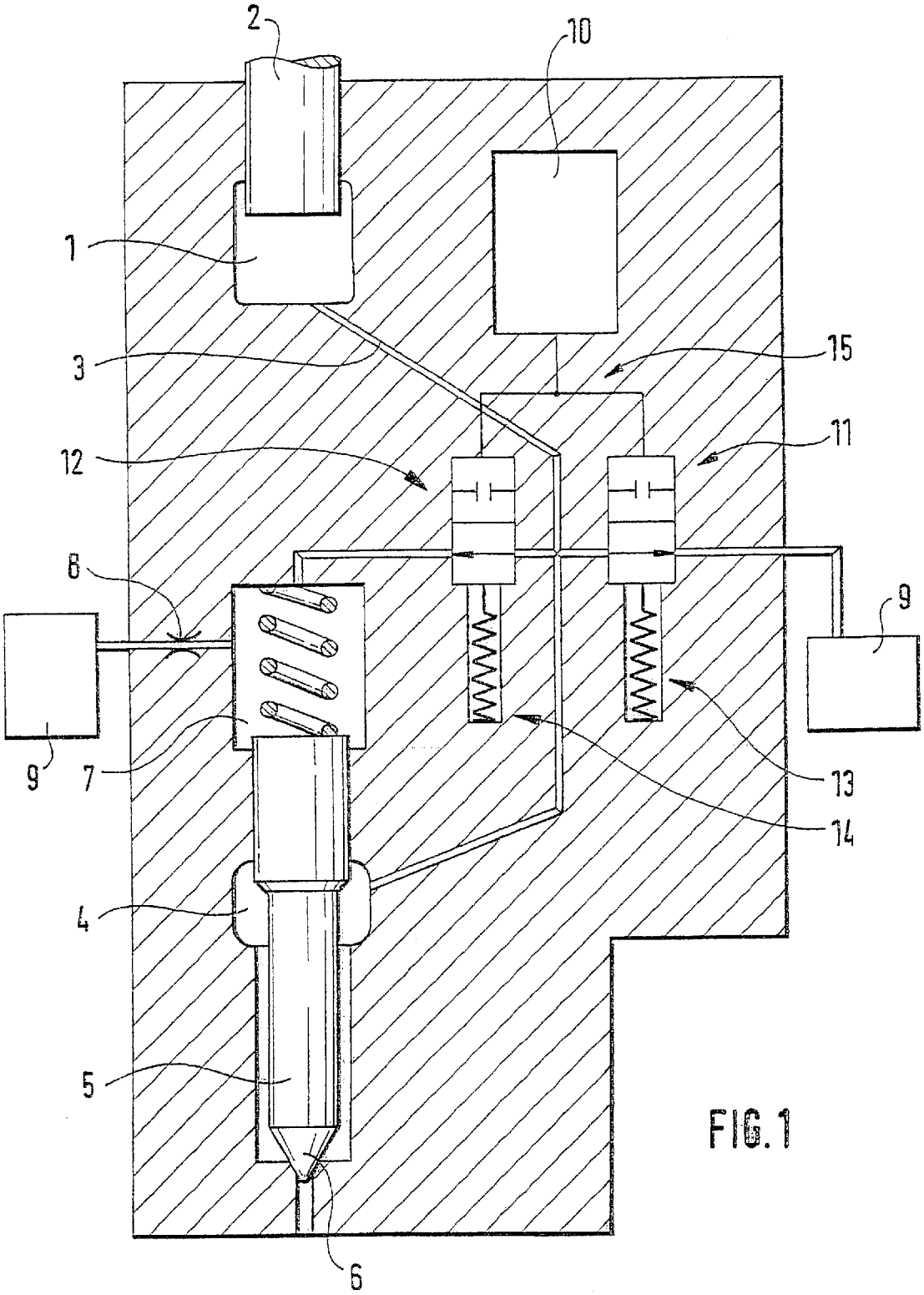
FIG. 1, a general basic sketch of the actuator triggering of two control valves of an injector.

FIG. 1 shows a general basic sketch of the actuator triggering of two control valves of an injector.

From the basic sketch, which is kept purely schematic, it can be seen that a pump chamber of an injector can be acted upon via a piston pressure, so that fuel that is at high pressure is supplied to a high-pressure line 3 that discharges into the control chamber 4 of a nozzle needle 5. In the injector housing, the nozzle needle 5 is supported movably and it can be acted upon by pressure via a nozzle spring chamber 7. From the nozzle needle spring chamber 7, a throttle element 8 branches off, by way of which fuel flows out into a low-pressure chamber 9—such as a tank.

The high-pressure line 3 is assigned two control valves 11, 12, which communicate with one another via a coupling chamber 15—schematically represented here by a line 15. Each of the two control valves 11 and 12 is assigned a separate spring element 13 and 14, respectively, by way of which the actuation pressures of the two control valves 11 and 12 can be established. The return of fuel to the low-pressure chamber 9 from the first control valve 11 is effected via a return line; the return from the second control valve 12 is effected via a line discharging into the nozzle needle spring chamber 7, via the throttle element 8 into the low-pressure chamber 9.

Figure 2:
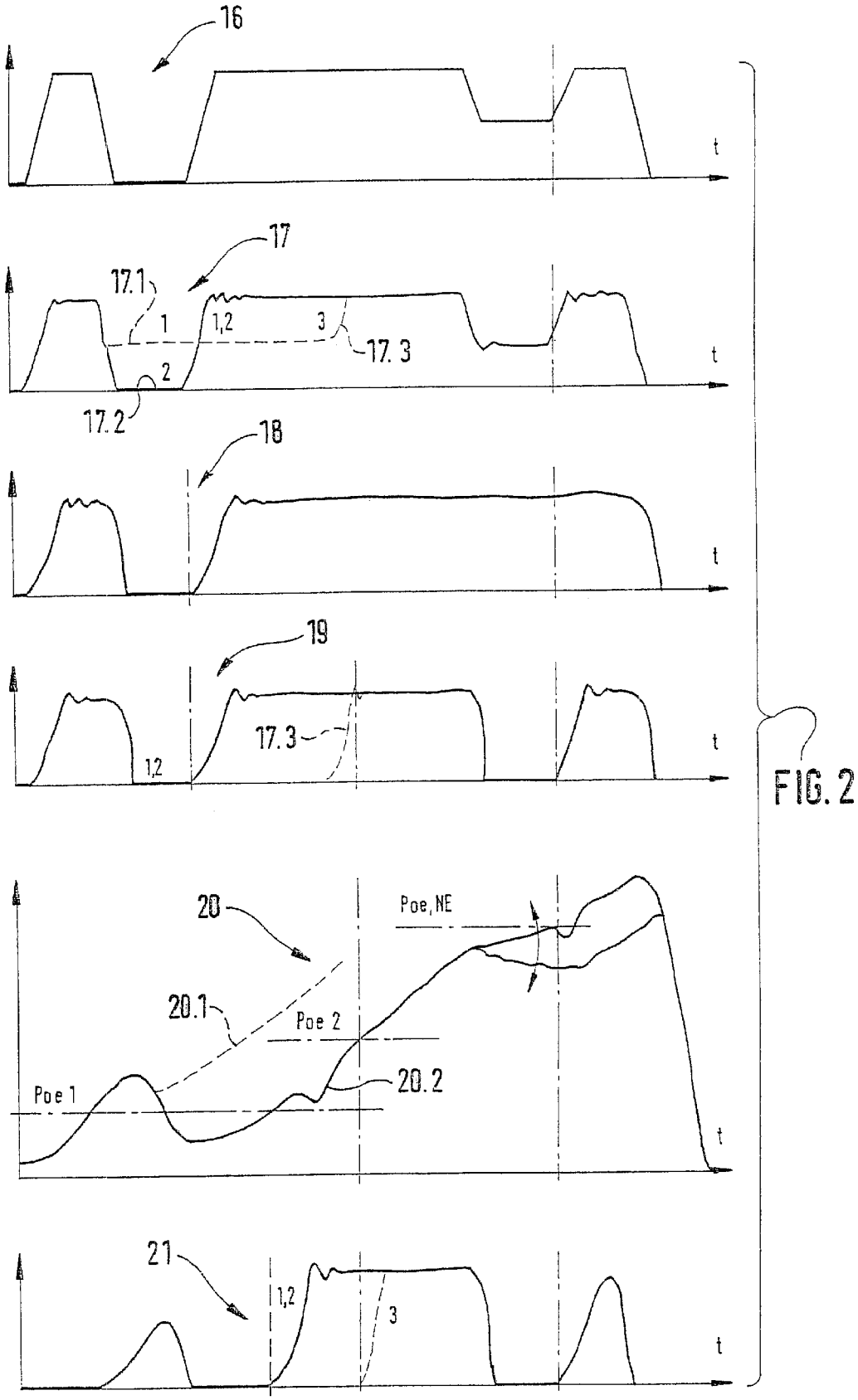
FIG. 2, a graph showing the actuator stroke for the pressure course in the coupling chamber, the stroke lengths of the two control valves, the injection pressure course, and the stroke course at the nozzle needle with postinjection, in each case plotted over the time axis.

FIG. 2 in graph form shows the actuator stroke, the pressure course in the coupling chamber, the stroke length courses of the first and second control valves, the resultant injection pressure course at various opening pressures at the control valves, and the course of the nozzle needle stroke, in each case plotted over the time axis.

The course of the stroke length 16 of piezoelectric actuator 10 is shown over the time axis and can be divided essentially into a first stroke phase, which corresponds to the preinjection, a longer-lasting main injection phase, and a shorter postinjection phase directly following the main injection phase.

Accordingly, a pressure course 17 is established in the coupling chamber 15; the various curves 17.1, 17.2 and 17.3 represent the opening pressure curves, each for different opening pressures at the first and second control valve 11 and 12, respectively.

The stroke length courses at the first control valve 11 and the second control valve 12 are represented by the curve courses 18 and 19, respectively. From the course of the valve stroke length at the first control valve 11, it can be seen that this valve takes on both the preinjection and the main burden of the main and postinjection phases. Conversely, the second control valve 12 contributes to increasing the pressure during the preinjection phase, as well as, by means of the stroke course shown for example at 17.3, to increase the pressure during the main injection phase. The instant of actuation of the second control valve 12 can be preselected individually to suit the opening pressures 17.1, 17.2, 17.3, so that the injection pressure course shown in the graph 20 can be varied individually.

In addition to a first pressure course, identified by reference numeral 20.1, an increase in the injection pressure that begins later can also be specified, as represented by the second injection pressure course 20.2. Thus many applications can be taken into account, since along with the pressure courses shown here as examples, arbitrary other pressure courses 20 of the injection pressure can also be attained. By means of the opening pressure course 17.3 at the second control valve 12, for instance, the onset of the injection pressure increase represented by the injection pressure course 20.2 can be specified and kept variable.

In accordance with the design of the cross-sectional area of the throttle element 8, which is provided in the outflow line to the low-pressure chamber 9 in FIG. 1, the injection pressure course 20 between the end of the main injection phase and the beginning of the postinjection phase can be modeled as indicated by the double arrow in the curve course 20; depending on the dimensioning of the throttle cross section at the throttle element 8 or 29, the pressure in the nozzle needle spring chamber 7 drops faster or slower, as a result of which the pressure course shown is established toward the end of the main injection phase.

Reference numeral 21 indicates the course of the nozzle needle stroke, which performs similarly to the stroke length course 19 of the second control valve 12. An opening phase during the preinjection event is followed directly by a main injection phase, whose beginning occurs earlier or later depending on the opening pressure established. Toward the end of the main injection, the nozzle needle 5 closes again, and after a period of time it opens, to enable a postinjection of fuel into the combustion chamber.

Figure 3:
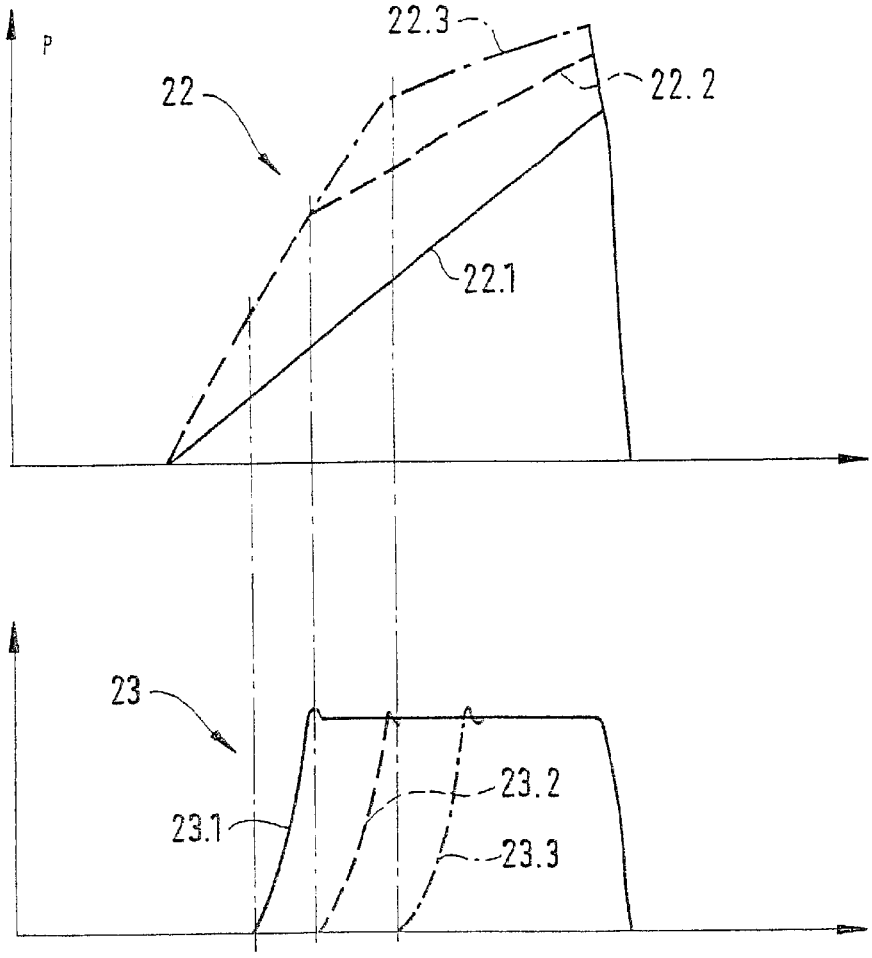
FIG. 3, the resultant nozzle opening pressure upon corresponding actuation of one of the control valves.

In FIG. 3, the pressure that is established at the injection nozzle is shown as a function of the stroke course of the nozzle needle.

The attainable variation in the injection pressure course by subjecting the nozzle spring chamber 7 to fuel that is at high pressure becomes an individually specifiable, variable nozzle opening pressure that is established in each case at the injection nozzle 6. The result is the corresponding pressure courses 22.1, 22.2, 22.3 and the associated nozzle needle stroke courses.

Figure 4:
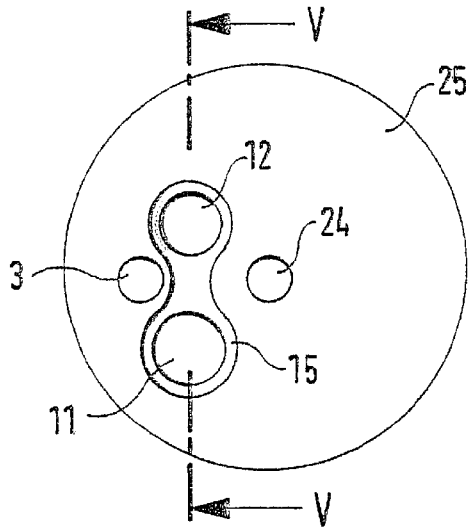
FIG. 4, a cross section through the injector housing.
Figure 6:
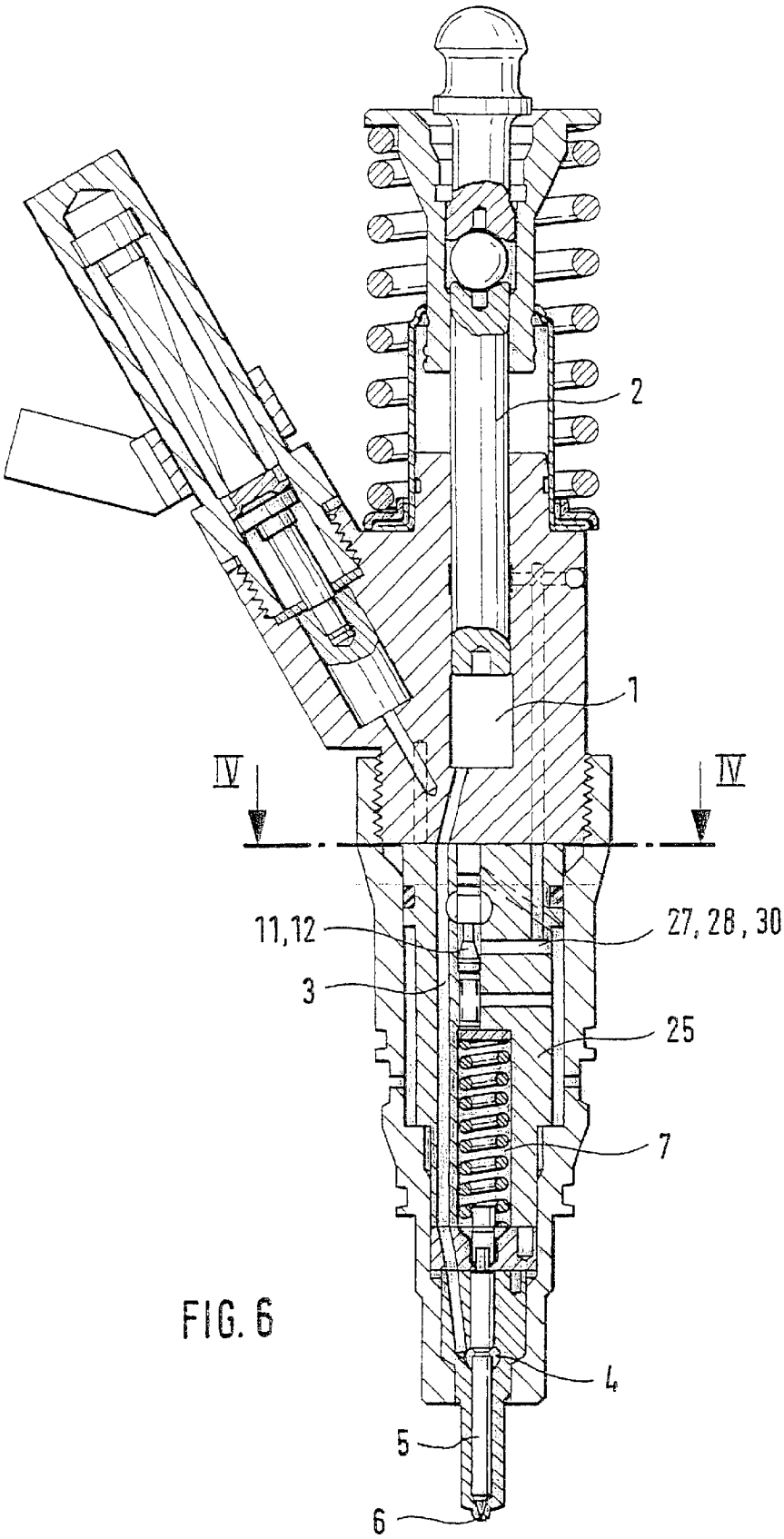

FIG. 4 shows a cross section through the injector housing 25 taken along the section line IV—IV of FIG. 6.

In the injector housing 25, which has a preferably cylindrical cross section, the control bore 24 and the high-pressure line 3 are shown, which extend adjacent to the control valves 11 and 12 that are also provided in the injector housing 25. Because of the geometric arrangement, an extremely compact structural form in the lower portion of the injector housing 25 can be attained. The control valves 11 and 12 are surrounded by a coupling chamber 15, which here is shown only schematically, connecting the two control valves 11, 12 to one another.

Figure 5:
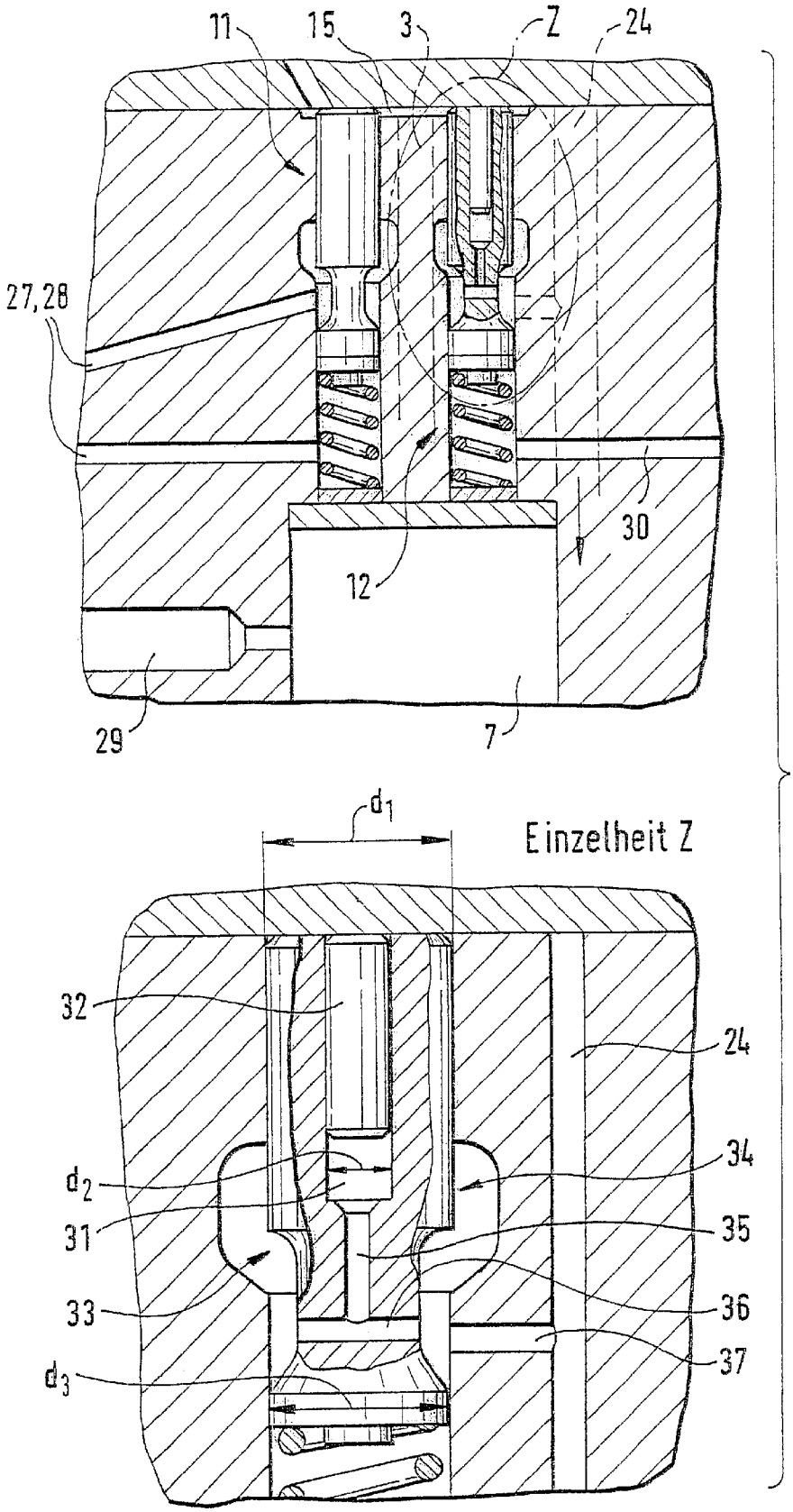
FIG. 5, an enlarged view of the control valves let into the injector housing, along with an enlarged view of a compensation system at one of the two control valves.

In the view of FIG. 5, an enlarged illustration of the two control valves 11 and 12 that are let into the injector housing and an enlarged view of a compensation system on one of the two control valves are shown.

Above the nozzle spring chamber 7, shown only schematically, without the spring element contained in it, two control valves 11, 12 located side by side are shown. On their upper ends, the two control valves 11, 12 communicate with one another by way of a coupling chamber 15. The high-pressure bore 3 extends between the two control valves 11 and 12, while the control bore 24 is shown folded laterally outward, for the sake of greater simplicity. The nozzle needle spring chamber 7 is assigned a throttle element 29, in the outflow line to the low-pressure chamber 9; the throttle element can be embodied with either a fixed or an adjustable cross section.

The first control valve 11 is assigned return lines 27 and 28 into the low-pressure chamber 9, while from the control chamber that surrounds the second control valve 12, as the detail Z shows, a bypass 37 discharges into the control bore 24.

From the second control valve 12, the return line 30 leads into the low-pressure chamber 9, but as shown in FIG. 5 without the interposition of a throttle element.

In the detail Z, the compensation system 34 at the second control valve 12 is shown on a larger scale. In the control part 33, embodied with the diameter $d_1$, there is a bore 31, into which a compensation piston 32 having the diameter $d_2$ is let. The bore 31 discharges into a narrowed bore 35, which in turn communicates with a transverse bore 36 in the control part 33. This transverse bore 36 discharges on both of its ends at the lower part of the control chamber that surrounds the control part 33 of the second control valve 12. From the control chamber, a bypass 37 branches off and connects the control chamber to the control bore 24, which in turn discharges into the nozzle needle spring chamber 7. In the region of the end of the second control valve oriented toward the spring element 14, the control part 33 is embodied with a diameter $d_3$. By means of the compensation piston 32 of the control part 33, which piston is acted upon from above with fuel pressure prevailing in the coupling chamber 15, and by means of the control bore 24 and the bypass 37, a pressure compensation is established at the control part 33 of the second control valve 12 if the relationship $d_1^2-d_3^2=d_2^2$ is met.

By means of the compensation system 34, the control valve 12 can be actuated easily even at very high pressure. As a result, it is possible at the nozzle needle 5, by means of increased pressure on the back side of the nozzle needle, to maintain elevated pressure in the closed state of the nozzle needle 5; the pressure already built up need not be reduced again for an optional postinjection, and thus a postinjection as indicated by the graphs 21 and 19 in FIG. 2 is again possible toward the end of the main injection at a higher pressure level.

FIG. 6 shows a longitudinal section through an injector.

From this illustration, it can be seen that the pump chamber 1 acted upon by means of the piston 2 discharges into the high-pressure line 3 in FIG. 1. The high-pressure line 3 in turn discharges into the control chamber 4 surrounding the nozzle needle 5; the injection nozzle 6 in turn discharges into the combustion chamber of an internal combustion engine. The nozzle needle 5 is acted upon in turn by a compression spring shown in the nozzle needle spring chamber 7. In the injector body 25, the control valves 11 and 12 are shown, but only one of them is shown in longitudinal section, for the sake of simplicity. The return lines 27, 28 and 30, beginning at the respective control valves 11 and 12, discharge into a hollow chamber, provided on the injector 25 and extending annularly, and from there the return flow of the fuel takes place into the tank.

Because the nozzle needle spring chamber 7 is subjected to fuel that is at high pressure and because the premature outflow of the fuel is prevented by a throttle element 8 and 29, an active control of the nozzle needle stroke can be attained. Because of pressure compensation at the control valve 12 that forms the injection pressure can be brought about by the compensation system 34, postinjections at a high pressure level can also be performed.

For sequencing the injection events, the control valves 11 and 12 are switched in succession; the different opening pressures of the control valves 11 and 12 can be provided either by means of differently dimensioned spring elements 13, 14—for instance in the form of helical springs. As an alternative to this, until the closure of the control valves 11 and 12, different fuel volumes can be released by them, and these volumes are then compensated for again by means of the actuator piston 2, in accordance with the relationship $A_2 \times h_2$ of control valve 12$>A_1 \times h_1$ of control valve 11, where $A_1$ is the hydraulically effective cross sectional area of control valve 11 and $h_1$ is the stroke thereof, $A_2$ is the hydraulically effective cross sectional area of control valve 12 and $h_2$ is the stroke thereof.

The foregoing relates to preferred exemplary embodiment of the invention, it being understood that other variants and embodiments thereof are possible within the spirit and scope of the invention, the latter being defined by the appended claims.

We claim:

1. An arrangement for injecting fuel that is at high pressure in an internal combustion engine, comprising an injector housing (25) enclosing a pressure chamber (1) from which a high-pressure line (3) discharges into a control chamber (4) of a nozzle needle (5), and two control valves (11 and 12) arranged side by side adjacent to one another contained in the injector housing (25), which control valves are coupled to one another by a common coupling chamber (15), the coupling chamber (15) being hydraulically connected to a piezoelectric actuator (10) contained in the injector housing, said control valves (11 and 12) communicate on the outlet side with regions (9) of a lesser pressure level, one of the control valves (11, 12) forming an injection pressure course (20) containing a pressure compensation system (34), by which the injection pressure course (20) can be varied by varying the stroke length (23) of the nozzle needle (5), said compensation system (34) allowing for actuation of said one control valve even at high pressures via said piezoelectric actuator (10).

2. The injection arrangement of claim 1, wherein the triggering of the nozzle needle (5) is decoupled from the high-pressure line (3) via a nozzle needle spring chamber 7.

3. The injection arrangement of claim 2, further comprising a throttle element (8, 29) provided in an outflow line of the nozzle needle spring chamber (7) leading to a low-pressure chamber 9.

4. The injection arrangement of claim 1, wherein said compensation system includes a chamber surrounding a control part (33), and said chamber surrounding the control part (33) communicates with a control pressure bore (24) by means of a bypass (37).

5. The injection arrangement of claim 4, wherein in the control part (33) a compensation piston (32) is received which is subjected to pressure via the coupling chamber (15) and which communicates via bores (35, 36) with the chamber surrounding the control part (33).

6. The injection arrangement of claim 1, wherein the pressure at the coupling chamber (15) above a control part (33) of said one control valve is equivalent to the pressure on an outlet side at the control part (33).

7. The injection arrangement of claim 2, wherein by means of the triggering of the nozzle needle (5) via a control bore (24) and the nozzle spring chamber (7), a reciprocating motion of the nozzle needle (5) at high pressure is brought about.

8. The injection arrangement of claim 1, wherein the control valves (11, 12) can be switched in succession, and different opening pressures of the control valves (11, 12) can be established by means of different spring elements (13, 14).

9. The injection arrangement of claim 1, wherein the control valves (11, 12) can be switched in succession, and until the valves close, different fuel volumes are released, in accordance with the relationship $A_2 \times h_2$ of the second control valve$>A_1 \times h_1$ of the first control valve, where A is the hydraulically effective cross sectional area of the control valve and h is the stroke thereof.

* * * * *